US011149330B2

(12) United States Patent
Na et al.

(10) Patent No.: US 11,149,330 B2
(45) Date of Patent: Oct. 19, 2021

(54) MAGNESIUM ALLOY PLATE AND METHOD FOR MANUFACTURING SAME

(71) Applicant: POSCO, Pohang-si (KR)

(72) Inventors: Hyun-Taek Na, Pohang-si (KR); In Shik Suh, Pohang-si (KR); Seok Jong Seo, Pohang-si (KR); Sung Il Kim, Pohang-si (KR)

(73) Assignee: POSCO, Pohang-si (KR)

( * ) Notice: Subject to any disclaimer, the term of this patent is extended or adjusted under 35 U.S.C. 154(b) by 157 days.

(21) Appl. No.: 16/472,971

(22) PCT Filed: Dec. 21, 2017

(86) PCT No.: PCT/KR2017/015263
§ 371 (c)(1),
(2) Date: Jun. 24, 2019

(87) PCT Pub. No.: WO2018/117696
PCT Pub. Date: Jun. 28, 2018

(65) Prior Publication Data

US 2020/0190637 A1 Jun. 18, 2020

(30) Foreign Application Priority Data

Dec. 23, 2016 (KR) ..... 10-2016-0177465

(51) Int. Cl.

| | |
|---|---|
| ***C22C 23/02*** | (2006.01) |
| ***B21B 1/46*** | (2006.01) |
| ***B21B 3/00*** | (2006.01) |
| ***C22F 1/06*** | (2006.01) |

(52) U.S. Cl.
CPC ..... *C22C 23/02* (2013.01); *B21B 1/463* (2013.01); *B21B 3/003* (2013.01); *C22F 1/06* (2013.01)

(58) Field of Classification Search
CPC ..... C22F 1/06; C22C 23/02
See application file for complete search history.

(56) References Cited

U.S. PATENT DOCUMENTS

| | | | |
|---|---|---|---|
| 2013/0017118 | A1 | 1/2013 | Jeong et al. |
| 2014/0271332 | A1 | 9/2014 | Kim et al. |

FOREIGN PATENT DOCUMENTS

| | | | |
|---|---|---|---|
| CN | 1693511 | A | 11/2005 |
| DE | 102011056560 | A1 | 6/2013 |
| EP | 1510265 | A1 | 3/2005 |
| EP | 3530766 | A2 | 8/2019 |
| JP | 2009-275274 | A | 11/2009 |
| JP | 2010-013725 | A | 1/2010 |
| JP | 2010-133005 | A | 6/2010 |
| JP | 2011-099140 | A | 5/2011 |
| JP | 2011-157626 | A | 8/2011 |
| JP | 2012-201928 | A | 10/2012 |
| KR | 10-2010-0027152 | A | 3/2010 |
| KR | 10-2010-0038809 | A | 4/2010 |
| KR | 10-2010-0087782 | A | 8/2010 |
| KR | 10-2012-0055304 | A | 5/2012 |
| KR | 10-1252784 | B1 | 4/2013 |
| KR | 10-2014-0085796 | A | 7/2014 |
| KR | 10-1610360 | B1 | 4/2016 |
| KR | 10-2016-0091863 | A | 8/2016 |

OTHER PUBLICATIONS

International Search Report issued in corresponding International Patent Application No. PCT/KR2017/015263 dated Apr. 3, 2018.
The extended European Search Report dated Sep. 25, 2019 issued in corresponding European Patent Application No. 17883120.2.

*Primary Examiner* — Jessee R Roe
(74) *Attorney, Agent, or Firm* — Morgan, Lewis & Bockius LLP

(57) ABSTRACT

According to an exemplary embodiment of the present invention, a manufacturing method of a magnesium alloy plate includes: (a) solution-treating a magnesium casting material containing 0.5 to 10 wt % of zinc (Zn), 1 to 15 wt % of aluminum (Al), and a balance of magnesium (Mg) and inevitable impurities at 300 to 500° C. for 1 to 48 hours; (b) pre-heating the solution-treated magnesium casting material at 300 to 500° C.; and (c) of rolling the pre-heated magnesium casting material together with a constraint member selected by following Relational Expression 1 to satisfy Relational Expressions 2 and 3; and (d) solution-treating a thus-rolled magnesium alloy plate at 300 to 500° C. for 0.5 to 5 hours. Relational Expressions 1 to 3 are as described in the specification.

6 Claims, 3 Drawing Sheets

MAGNESIUM ALLOY PLATE AND METHOD FOR MANUFACTURING SAME

CROSS-REFERENCE OF RELATED APPLICATIONS

This application is the U.S. National Phase under 35 U.S.C. § 371 of International Patent Application No. PCT/KR2017/015263, filed on Dec. 21, 2017, which in turn claims the benefit of Korean Patent Application No. 10-2016-0177465, filed Dec. 23, 2016, the entire disclosures of which applications are incorporated by reference herein.

TECHNICAL FIELD

The present invention relates to a magnesium alloy plate and a manufacturing method thereof.

BACKGROUND ART

In recent years, there has been a growing demand for lighter weight of transportation equipment for improving fuel efficiency in response to strengthening of international environmental regulations and strengthening of fuel economy regulations. For this purpose, the development of techniques for the application of magnesium, which is a representative lightweight metal, as a casting material, has been actively pursued. However, magnesium castings have a hexagonal close packed (HCP) crystal structure, which has a disadvantage that a slip system operated at room temperature is limited. Particularly, such a slip system is very disadvantageous in press formability in a basal texture formed on a magnesium alloy plate after rolling.

Korean Patent Application Publication No. 2010-0038809 and Korean Patent Publication No. 2012-0055304 propose a technique for improving formability by distributed control of textures and grain refinement by a recrystallization phenomenon in casting/rolling of a thin plate by adding yttrium (Y) and calcium (Ca) thereto. In addition, US Patent Application Publication No. 2013-0017118 proposes a technique for relaxing a basal texture by heat treatment after addition of shear strain to a magnesium alloy plate with different rotational speeds of upper/lower rolls during rolling.

However, according to this technique, even when expensive yttrium and calcium are added, a limited dome height (LDH) at room temperature is 5 mm or less, which shows low cold formability. In addition, a differential speed rolling technique using different rotational speeds of upper/lower rolls has a limitation in improving the formability since the shear strain is concentrated only on a surface layer thereof.

PRIOR ART DOCUMENT

Patent Document (Patent Document 1) 1. Korean Patent Application Publication No. 2010-0038809

(Patent Document 2) 2. Korean Patent Application Publication No. 2012-0055304

(Patent Document 3) 3. US Patent Application Publication No. second 013-0017118

DISCLOSURE

The present invention has been made in an effort to provide a magnesium alloy plate having excellent cold formability and a manufacturing method thereof. Specifically, the present invention has been made in an effort to provide a magnesium alloy plate having excellent cold formability with a limited dome height (LDH) of 10 mm or more at room temperature.

An exemplary embodiment of the present invention provides a magnesium alloy plate, including 0.5 to 10 wt % of zinc (Zn), 1 to 15 wt % of aluminum (Al), and a balance of magnesium (Mg) and inevitable impurities, wherein an average value of a texture intensity within a misorientation level of 30° or less is 3 or less based on an [0001] orientation of a (0002) plane.

In the magnesium alloy plate, a deviation of c/a values of a hexagonal closed packed (HCP) crystal structure in the plate may be 5 or less.

In the magnesium alloy plate, a limited dome height (LDH) at room temperature may be 10 mm or more.

A thickness of the magnesium alloy plate may be in a range of 0.4 to 2 mm.

An exemplary embodiment of the present invention provides a manufacturing method of a magnesium alloy plate, including: (a) solution-treating a magnesium casting material containing 0.5 to 10 wt % of zinc (Zn), 1 to 15 wt % of aluminum (Al), and a balance of magnesium (Mg) and inevitable impurities at 300 to 500° C. for 1 to 48 hours; (b) pre-heating the solution-treated magnesium casting material at 300 to 500° C., and (c) rolling the pre-heated magnesium casting material together with a constraint member selected by the following Relational Expression 1 to satisfy Relational Expressions 2 and 3; and (d) solution-treating a thus-rolled magnesium alloy plate at 300 to 500° C. for 0.5 to 5 hours.

$$1<|(\sigma_{mat}-\sigma_{mg})|\times\sigma_{mg}^{-1}<20 \quad \text{Relational Expression 1}$$

Herein, $\sigma_{mat}$ and $\sigma_{mg}$ are a constraint member and a mean flow stress (MFS) of the magnesium material, respectively.

$$0.4<N_{Reff}\times(N_{Rtotal}-1)^{-1} \quad \text{Relational Expression 2}$$

Herein, $N_{Reff}$ is a number of rolling passes to which a strain that is equal to or greater than an effective strain ($\varepsilon_{eff}$) is applied, and $N_{Rtotal}$ is a total number of rolling passes.

$$3<\varepsilon_{eff}\times100<40 \quad \text{Relational Expression 3}$$

Herein, $\varepsilon_{eff}=(T-T_0)\times L_{ini}^{-1}$, and $T_0$ and T are pre-deformation and post-deformation thicknesses of the magnesium plate, respectively.

The constraint member may be designed to have a thickness exceeding 5% of the magnesium casting material.

The rolling may be constrained rolling that is performed at a cumulative reduction ratio of 50% or more.

An oil-coating treatment or a plating treatment may be further performed after the rolling.

A magnesium alloy plate according to an exemplary embodiment of the present invention, which is manufactured depending on the manufacturing method, may have a non-basal texture that is uniform in a thickness direction.

In the magnesium alloy plate manufactured depending on the above-described manufacturing method, a limited dome height (LDH) at room temperature may be 10 mm or more.

The present invention has been made in an effort to provide a magnesium alloy plate having excellent cold formability and a manufacturing method thereof. Specifically, the present invention has been made in an effort to provide a magnesium alloy plate having excellent cold formability with a limited dome height (LDH) of 10 mm or more at room temperature.

MODE FOR INVENTION

Figure 1:
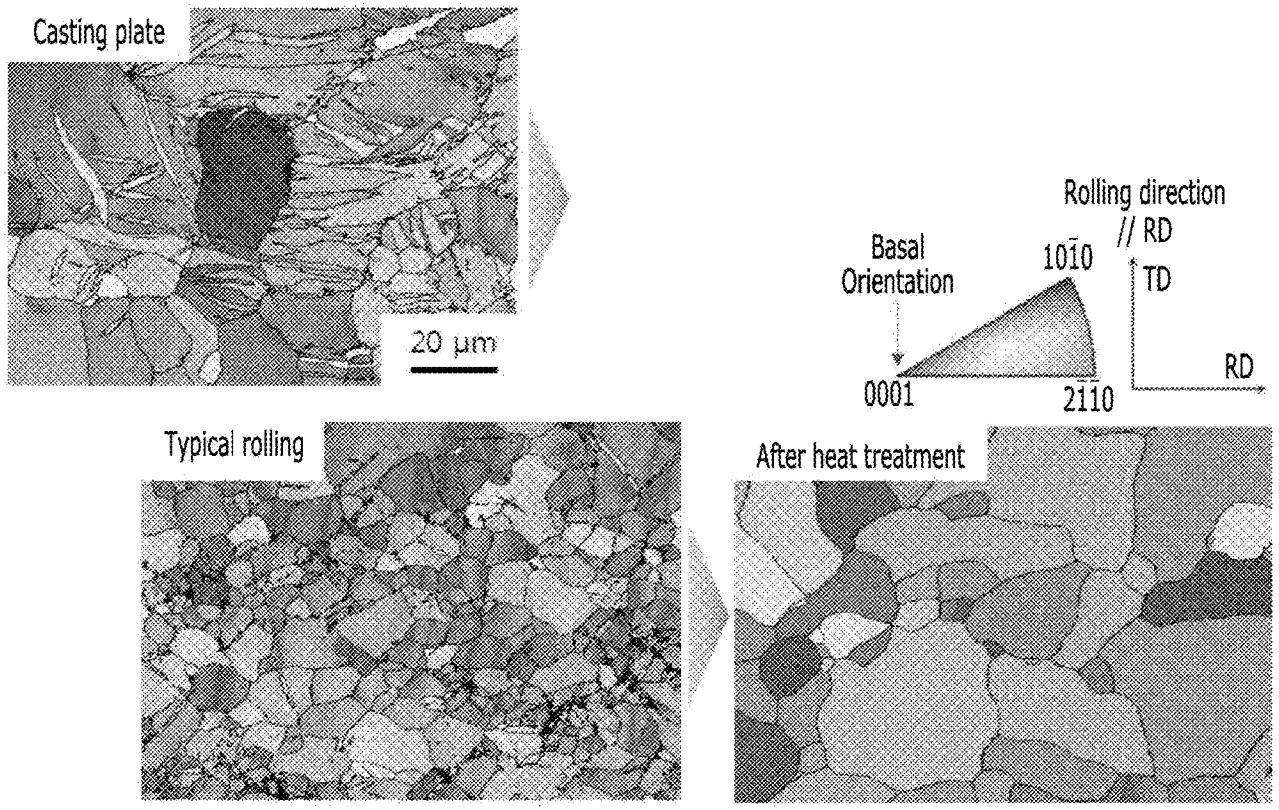
FIG. 1 illustrates a crystalline structure of a magnesium alloy rolled plate using electron backscatter diffraction (EBSD) according to Comparative Example 1.

It will be understood that, although the terms first, second, third, etc. may be used herein to describe various elements, components, regions, layers, and/or sections, they are not limited thereto. These terms are only used to distinguish one element, component, region, layer, or section from another element, component, region, layer, or section. Thus, a first component, constituent element, or section described below may be referred to as a second component, constituent element, or section, without departing from the range of the present invention.

The terminologies used herein are used just to illustrate a specific exemplary embodiment, but are not intended to limit the present invention. It must be noted that, as used in the specification and the appended claims, singular forms used herein include plural forms unless the context clearly dictates the contrary. It will be further understood that the term "comprises" or "includes", used in this specification, specifies stated properties, regions, integers, steps, operations, elements, and/or components, but does not preclude the presence or addition of other properties, regions, integers, steps, operations, elements, components, and/or groups.

Unless defined otherwise, all terms including technical and scientific terms used herein have the same meaning as commonly understood by one of ordinary skill in the art to which the present invention belongs. Terms defined in commonly used dictionaries are further interpreted as having meanings consistent with the relevant technical literature and the present disclosure, and are not to be construed as idealized or very formal meanings unless defined otherwise.

Unless otherwise stated, % indicates % by weight (wt %).

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

According to an exemplary embodiment of the present invention, a magnesium alloy plate includes 0.5 to 10 wt % of zinc (Zn), 1 to 15 wt % of aluminum (Al), and a balance of magnesium (Mg) and inevitable impurities, wherein an average value of a texture intensity within a misorientation level of 30° or less is 3 or less based on a [0001] orientation of a (0002) plane. For example, at points ¼t and ½t in a thickness direction, an average value of a texture intensity within a misorientation level of 30° or less may be 3 or less based on a [0001] orientation of a (0002) plane.

In addition, a deviation of c/a values of a hexagonal closed packed (HCP) crystal structure in the plate is 5 or less. Specifically, a difference in the c/a values may be 4% or less. More specifically, the difference in the c/a values may be 3% or less. Furthermore, a difference in the c/a values may be 2% or less.

Accordingly, the magnesium alloy plate of the present exemplary embodiment may have excellent cold formability in which a limited dome height (LDH) at room temperature is 10 mm or more.

Hereinafter, components of the magnesium casting material according to an exemplary embodiment of the present invention will be described.

The magnesium casting material according to the present exemplary embodiment includes 0.5 to 10 wt % of zinc (Zn), 1 to 15 wt % of aluminum (Al), and a balance of magnesium (Mg) and inevitable impurities. A reason why an alloy composition of the magnesium casting material is limited in the present invention will be described below, and % indicates % by weight.

Zinc (Zn)

Zinc has an effect of increasing strength of the magnesium alloy plate. When zinc is added in an amount of less than 0.5%, the effect is insufficient, so the strength is reduced, and when it exceeds 10%, a coarse equilibrium phase is formed in grain boundaries to reduce the formability. Therefore, the content of zinc may preferably be in a range of 0.5 to 10%.

Aluminum (Al)

Aluminum has an effect of improving corrosion resistance and elongation in the magnesium alloy plate. However, when it is added in an amount of less than 1%, the effect is insufficient, so it is difficult to achieve target physical properties. In addition, when it exceeds 15%, the manufacture is not easy, and the efficiency is low in terms of ensuring light weight, and thus the content of aluminum may preferably be in a range of 1 to 15%.

According to an exemplary embodiment of the present invention, a manufacturing method of a magnesium alloy plate includes: (a) solution-treating a magnesium casting material containing 0.5 to 10 wt % of zinc (Zn), 1 to 15 wt % of aluminum (Al), and a balance of magnesium (Mg) and inevitable impurities at 300 to 500° C. for 1 to 48 hours; (b) pre-heating the solution-treated magnesium casting material at 300 to 500° C.; and (c) rolling the pre-heated magnesium casting material together with a constraint member selected by following Relational Expression 1 to satisfy Relational Expressions 2 and 3; and (d) solution-treating a thus-rolled magnesium alloy plate at 300 to 500° C. for 0.5 to 5 hours.

Hereinafter, the manufacturing process of the present exemplary embodiment will be described in detail step by step.

The magnesium casting material having such components is solution-treated at 300 to 500° C. for 1 to 48 hours. When it is solution-treated at less than 300° C., a cast texture remains so that it is difficult to form uniform micro-textures, and thus the cold formability locally deteriorates after the manufacture. When such heat treatment is performed at more than 500° C., the material is melted, or a coarse micro-texture is formed to reduce the cold formability. In addition, when the heat treatment is performed for less than 1 hour, uniform micro-texture may not be obtained, and when it exceeds 48 hours, the uniformization effect of the texture is remarkably reduced and economically disadvantageous.

The solution-treated magnesium casting material is preheated at 300 to 500° C. When preheating at a temperature of less than 300° C., a recrystallization effect during rolling is insufficient and the uniformity of the micro-texture is lacking, and when the temperature exceeds 500° C., the cold formability is reduced due to abnormal growth of crystal grains.

The pre-heated magnesium casting material may be rolled together with a constraint member selected by the following Relational Expression 1 to satisfy Relational Expressions 2 and 3:

$$1<|(\sigma_{mat}-\sigma_{mg})|\times\sigma_{mg}^{-1}<20 \quad \text{Relational Expression 1}$$

wherein $\sigma_{mat}$ and $\sigma_{mg}$ are a constraint member and a mean flow stress (MFS) of the magnesium material, respectively, $$0.4<N_{Reff}\times(N_{Rtotal}-1)^{-1} \quad \text{Relational Expression 2}$$

wherein $N_{Reff}$ is a number of rolling passes to which a strain that is equal to or greater than an effective strain ($\varepsilon_{eff}$) is applied, and $N_{Rtotal}$ is a total number of rolling passes, and $$3<\varepsilon_{eff}\times100<40 \quad \text{Relational Expression 3}$$

wherein $\varepsilon_{eff}=(T-T_0)\times L_{ini}^{-1}$, and $T_0$ and T are pre-deformation and post-deformation thicknesses of the magnesium plate, respectively.

When a value of Relational Expression 1 is less than 1, strain resistance of the constraint member is very small, and thus the forming of the constraint member proceeds excessively in spite of a small reduction amount so that a sufficient constraining rolling effect cannot be imparted from an interface with the magnesium plate to a center portion of the magnesium plate. On the other hand, when it exceeds 20, the strain resistance of the constraint member is very high, which may cause a mass flow problem due to an increase in a rolling load amount, and the strain resistance of the constrain member is very large as compared with the strain resistance of the magnesium plate, and thus a compressive strain behavior that is different from a constraint strain behavior of multi-axes to be formed from a magnesium interface is predominant, so that a constraint rolling effect cannot be effectively imparted to the point of ½t in the thickness direction.

For Relational Expression 2 relating to a number of rolling passes that is equal to or greater than an effective strain ($\varepsilon_{eff}$), which is necessary until a non-basal texture is effectively formed when the rolling is performed by applying materials selected based on the above, it is preferable that the rolling is started with an aim of adjusting a thickness of the material for securing a final target thickness, similar to an ordinary rough rolling process, for an initial one pass or more, and the rolling is performed at a reduction ratio at which a strain that is equal to or greater than the effective strain ($\varepsilon_{eff}$) is applied thereto. At the same time, the reduction ratio at which the strain that is equal to or greater than the effective strain ($\varepsilon_{eff}$) should satisfy Relational Expression 3. When a value of Relational Expression 3 is less than 3, a shear strain effect caused by the low reduction ratio is remarkably reduced, and thus the non-basal texture is not effectively formed. When it exceeds 40, not only is efficiency lowered in terms of securing the shear strain effect, but it is also difficult to smoothly carry out the operation due to mass flow deterioration when a magnesium material is rolled together with a constraint member having a different strain ratio.

A thus-rolled magnesium alloy plate is solution-treated at 300 to 500° C. for 0.5 to 5 hours. When the solution treatment is performed at less than 300° C., a recrystallization behavior is not sufficient, and thus a stretched rolled texture remains, resulting in deterioration of the cold formability. When the solution treatment is performed at more than 500° C., the material is locally melted, or a coarse micro-texture is formed to deteriorate the cold formability. When the heat treatment is performed for less than 0.5 hours, uniformly recrystallized micro-texture may not be obtained, and when it exceeds 5 hours, the uniformization effect of the texture is remarkably reduced.

In the magnesium alloy plate manufactured by selecting materials satisfying Relational Expression 1 for the difference in strain resistance between applied materials as described above and considering Relational Expressions 2 and 3, a non-basal texture is effectively formed, and in this case, an average value of a texture intensity within a misorientation level of −30° or less is 3 or less based on an [0001] orientation of a (0002) plane. In addition, the magnesium alloy plate according to the present invention is characterized in that a deviation of c/a values of a hexagonal closed packed (HCP) crystal structure is 5 or less, and very uniform non-basal textures can be formed, and resultantly a limited dome height of 10 mm or more can be secured even at room temperature. Specifically, a difference in the c/a values may be 4% or less. More specifically, the difference in the c/a values may be 3% or less. Furthermore, a difference in the c/a values may be 2% or less.

For example, the magnesium alloy plate according to the exemplary embodiment of the present invention may have a thickness of 0.4 to 2 mm, but the present invention is not limited thereto.

Hereinafter, the present invention will be described in more detail with reference to examples, and a description of these examples is intended only to illustrate the implementation of the present invention, but the present invention is not limited thereto.

(Manufacture of Magnesium Alloy Plate)

Examples 1 to 7 and Comparative Examples 1 to 9

A molten magnesium alloy was prepared by dissolving components listed in Table 1 under a mixed gas atmosphere of $CO_2$ and $SF_6$ based on consideration of wt % of the components, and a plate-like casting material was formed through a twin roll thin plate casting machine. The molten alloy was transported to a nozzle while being maintained at 710° C. in consideration of the temperature before ignition (about 950° C.), to be injected between the two cooling rolls. In this case, a gap between the two cooling rolls was maintained to be about 4 mm, and the casting was carried out at a cooling rate of 200 to 300° C./s while maintaining a rotation rate of the rolls at about 5 mpm. A thus-cast plate was subjected to subsequent heat treatment as follows. First, the cast plate was subjected to heat treatment at 440° C. for 1 hour in order to remove a casting structure and segregation as much as possible.

Next, a magnesium casting material that is subjected to such heat treatment is applied as a material having a value of less than 1 in Relational Expression 1, a pure aluminum plate is applied to a material having a value of more than 20, and a MART steel having a martensite matrix of 400 MPa is applied as a constraint member. In addition, mild steel, STS304 steel, and TWIP steel, which were materials belonging to an appropriate range depending on Relational Expression 1, were selected as a constraint member, and the rolling was performed by varying thickness ratios between constituent materials at 4.5% to 100% based on the magnesium casting plate. Preheating at 400° C. for 30 min before rolling was followed by rolling, additional preheating and rolling were repeated for 5 minutes at 400° C. per pass during hot rolling, the constraint member was removed, and then final heat treatment was performed at 400° C. to finally recrystallize the magnesium alloy plate.

Table 1 and Table 2 show components, material qualities, and MFS indicating mutual strain resistance differences of the magnesium casting material and the constraint member, and results of Relational Expression 1. TS, YS, and EI indicate JS5 standards and tensile material qualities in a C direction of the plate-like magnesium casting material having a thickness of 4 mm and the constraint member having various corresponding thicknesses at room temperature, and MFS indicates a measurement result when a strain of 0.1 $s^{-1}$ is given at 400° C.

Table 3 shows thickness ratios before rolling, cumulative reduction ratios, $N_{Reff}$, $N_{Rtotal}$, and $\varepsilon_{eff}$ values, and heat treatment conditions after final rolling.

Table 4 summarizes tensile material qualities at room temperature for a constraint-rolled magnesium alloy plate from which the constraint member is removed after the rolling, results of $I_{ave\ (1/4t)}$ (−30°), $I_{ave\ (1/2t)}$ (−30°), and c/a deviations of micro-texture at points ¼t and ½t using a EBSD/OIM and TEM analysis method, and values of limited dome height, depending on each example and comparative example. A limited dome height test was performed to evaluate formability of the magnesium alloy plate after casting, rolling, and post-heat treatment. For the limited dome height test, a disc-shaped test piece having a diameter of 50 mm and a thickness of 1 to 1.5 mm was prepared to be inserted between upper and lower dies and then was fixed with a force of 5 kN, a spherical punch having a diameter of 27 mm was used to apply deformation thereto at a speed of 0.1 mm/s to be inserted until the disk-shaped test piece was fractured, and a deformation height at the time of the fracture was measured.

TABLE 1

| | Magnesium casting plate (wt %) | | | | | Constraint member (wt %) | | | | | | | |
|---|---|---|---|---|---|---|---|---|---|---|---|---|---|
| | Zn | Al | Ca | Y | Mg | Material | C | Mn | Si | Ni | Cr | Al | Mg |
| Example 1 | 0.75 | 2.73 | — | — | Bal. | STS304 | 0.08 | 2.0 | 1.0 | 8.5 | 18 | — | — |
| Example 2 | 0.75 | 2.73 | — | — | Bal. | STS304 | 0.08 | 2.0 | 1.0 | 8.5 | 18 | — | — |
| Example 3 | 0.75 | 2.73 | — | — | Bal. | TWIP | 0.55 | 16.5 | 1.5 | — | — | — | — |
| Example 4 | 0.75 | 2.73 | — | — | Bal. | TWIP | 0.55 | 16.5 | 1.5 | — | — | — | — |
| Example 5 | 0.75 | 2.73 | — | — | Bal. | Mild | 0.16 | 0.8 | 0.2 | — | — | — | — |
| Example 6 | 0.83 | 2.76 | — | 1.51 | Bal. | Mild | 0.16 | 0.8 | 0.2 | — | — | — | — |
| Example 7 | 0.81 | 2.75 | 0.16 | — | Bal. | Mild | 0.16 | 0.8 | 0.2 | — | — | — | — |
| Comparative Example 1 | 0.75 | 2.73 | — | — | Bal. | — | — | — | — | — | — | — | — |
| Comparative Example 2 | 0.83 | 2.76 | — | 1.51 | Bal. | — | — | — | — | — | — | — | — |
| Comparative Example 3 | 0.81 | 2.75 | 0.16 | — | Bal. | — | — | — | — | — | — | — | — |
| Comparative Example 4 | 0.75 | 2.73 | — | — | Bal. | Pure Al | — | — | — | — | — | 99.9 | — |
| Comparative Example 5 | 0.75 | 2.73 | — | — | Bal. | MART steel | 0.21 | — | — | 10 | 12 | 0.1 | — |
| Comparative Example 6 | 0.75 | 2.73 | — | — | Bal. | STS304 | 0.08 | 2.0 | 1.0 | 8.5 | 18 | — | — |
| Comparative Example 7 | 0.75 | 2.73 | — | — | Bal. | STS304 | 0.08 | 2.0 | 1.0 | 8.5 | 18 | — | — |
| Comparative Example 8 | 0.75 | 2.73 | — | — | Bal. | STS304 | 0.08 | 2.0 | 1.0 | 8.5 | 18 | — | — |
| Comparative Example 9 | 0.75 | 2.73 | — | — | Bal. | STS304 | 0.08 | 2.0 | 1.0 | 8.5 | 18 | — | — |

TABLE 2

| | Magnesium casting plate | | | | Constraint member | | | | |
|---|---|---|---|---|---|---|---|---|---|
| | TS (MPa) | YS (MPa) | EI (%) | MFS (MPa) | TS (MPa) | YS (MPa) | EI (%) | MFS (MPa) | Relational Expression 1 |
| Example 1 | 250 | 150 | 22 | 120 | 771 | 550 | 33 | 469 | 2.91 |
| Example 2 | 250 | 150 | 22 | 120 | 771 | 550 | 33 | 469 | 2.91 |
| Example 3 | 250 | 150 | 22 | 120 | 1030 | 671 | 46 | 683 | 4.69 |
| Example 4 | 250 | 150 | 22 | 120 | 1030 | 671 | 46 | 683 | 4.69 |
| Example 5 | 250 | 150 | 22 | 120 | 440 | 360 | 12 | 281 | 1.34 |
| Example 6 | 210 | 170 | 15 | 110 | 440 | 360 | 12 | 281 | 1.55 |
| Example 7 | 217 | 175 | 15 | 113 | 440 | 360 | 12 | 281 | 1.49 |
| Comparative Example 1 | 250 | 150 | 22 | 120 | — | — | — | — | — |
| Comparative Example 2 | 210 | 170 | 15 | 110 | — | — | — | — | — |
| Comparative Example 3 | 217 | 175 | 15 | 113 | — | — | — | — | — |
| Comparative Example 4 | 250 | 150 | 22 | 120 | 80 | 17 | 40 | 15 | 0.88 |

TABLE 2-continued

| | Magnesium casting plate | | | | Constraint member | | | | |
|---|---|---|---|---|---|---|---|---|---|
| | TS (MPa) | YS (MPa) | EI (%) | MFS (MPa) | TS (MPa) | YS (MPa) | EI (%) | MFS (MPa) | Relational Expression 1 |
| Comparative Example 5 | 250 | 150 | 22 | 120 | 4410 | 4340 | 4 | 3250 | 26.08 |
| Comparative Example 6 | 250 | 150 | 22 | 120 | 771 | 550 | 33 | 469 | 2.91 |
| Comparative Example 7 | 250 | 150 | 22 | 120 | 771 | 550 | 33 | 469 | 2.91 |
| Comparative Example 8 | 250 | 150 | 22 | 120 | 771 | 550 | 33 | 469 | 2.91 |
| Comparative Example 9 | 250 | 150 | 22 | 120 | 771 | 550 | 33 | 469 | 2.91 |

TABLE 3

| | Thickness ratio (%) | | Rolling | Cumulative Reduction ratio | | | Relational | Relational Expression |
|---|---|---|---|---|---|---|---|---|
| | Mg | Constraint | Mode | (%) | $N_{Reff}$ | $N_{Rtotal}$ | Expression 2 | 3 |
| Example 1 | 50 | 50 | Constraint | 70 | 7 | 12 | 0.64 | 6 |
| Example 2 | 50 | 50 | Constraint | 80 | 8 | 13 | 0.67 | 6 |
| Example 3 | 50 | 50 | Constraint | 70 | 7 | 12 | 0.64 | 6 |
| Example 4 | 65 | 35 | Constraint | 70 | 7 | 12 | 0.64 | 7 |
| Example 5 | 50 | 50 | Constraint | 80 | 8 | 13 | 0.67 | 6 |
| Example 6 | 50 | 50 | Constraint | 70 | 7 | 12 | 0.64 | 7 |
| Example 7 | 50 | 50 | Constraint | 70 | 7 | 12 | 0.64 | 8 |
| Comparative Example 1 | 100 | — | Normal | 70 | 7 | 12 | 0.64 | 6 |
| Comparative Example 2 | 100 | — | Normal | 70 | 7 | 12 | 0.64 | 8 |
| Comparative Example 3 | 100 | — | Normal | 70 | 7 | 12 | 0.64 | 8 |
| Comparative Example 4 | 50 | 50 | Constraint | 70 | 6 | 12 | 0.55 | 6 |
| Comparative Example 5 | 50 | 50 | Constraint | 50 | 5 | 12 | 0.45 | 5 |
| Comparative Example 6 | 50 | 50 | Constraint | 30 | 2 | 5 | 0.50 | 6 |
| Comparative Example 7 | 96 | 4 | Constraint | 70 | 7 | 12 | 0.64 | 7 |
| Comparative Example 8 | 50 | 50 | Constraint | 70 | 1 | 12 | 0.09 | 5 |
| Comparative Example 9 | 50 | 50 | Constraint | 70 | 1 | 36 | 0.03 | 6 |

TABLE 4

| | Constraint-rolled Magnesium alloy plate material | | | | $I_{ave\ (1/2t)}$ | | | | | |
|---|---|---|---|---|---|---|---|---|---|---|
| | TS (MPa) | YS (MPa) | EI (%) | Thickness (mm) | $I_{ave\ (1/4t)}$ (−30°) | $I_{ave\ (1/2t)}$ (−30°) | $c/a_{(1/4t)}$ | $c/a_{(1/2t)}$ | Δc/a | LDH (mm) |
| Example 1 | 270 | 170 | 28 | 1.2 | 2.1 | 2.2 | 1.871 | 1.875 | 0.21 | 10.9 |
| Example 2 | 290 | 185 | 28 | 0.8 | 1.2 | 1.4 | 1.890 | 1.865 | 1.34 | 11.2 |
| Example 3 | 301 | 191 | 27 | 1.2 | 1.9 | 1.9 | 1.850 | 1.849 | 0.05 | 13.3 |
| Example 4 | 310 | 199 | 27 | 1.2 | 1.6 | 1.6 | 1.881 | 1.867 | 0.75 | 14.1 |
| Example 5 | 293 | 188 | 27 | 0.8 | 1.7 | 1.9 | 1.888 | 1.872 | 0.85 | 11.6 |
| Example 6 | 280 | 169 | 25 | 1.2 | 1.8 | 1.8 | 1.825 | 1.812 | 0.72 | 12.1 |
| Example 7 | 282 | 174 | 25 | 1.2 | 1.9 | 2.0 | 1.829 | 1.863 | 1.83 | 12.5 |
| Comparative Example 1 | 270 | 175 | 21 | 1.2 | 5.9 | 7.1 | 1.631 | 1.506 | 8.30 | 2.5 |
| Comparative Example 2 | 260 | 172 | 21 | 1.2 | 4.1 | 6.0 | 1.645 | 1.518 | 8.37 | 6.3 |

TABLE 4-continued

| | Constraint-rolled Magnesium alloy plate material | | | | $I_{ave\ (1/2t)}$ | | | | | |
|---|---|---|---|---|---|---|---|---|---|---|
| | TS (MPa) | YS (MPa) | EI (%) | Thickness (mm) | $I_{ave\ (1/4t)}$ (−30°) | $I_{ave\ (1/2t)}$ (−30°) | $c/a_{(1/4t)}$ | $c/a_{(1/2t)}$ | Δc/a | LDH (mm) |
| Comparative Example 3 | 285 | 181 | 22 | 1.2 | 3.5 | 5.5 | 1.647 | 1.529 | 7.72 | 7.1 |
| Comparative Example 4 | 255 | 162 | 24 | 1.2 | 4.7 | 6.4 | 1.657 | 1.528 | 8.44 | 3.5 |
| Comparative Example 5 | 275 | 167 | 22 | 2.0 | 2.1 | 5.2 | 1.869 | 1.571 | 18.97 | 4.3 |
| Comparative Example 6 | 258 | 150 | 22 | 2.8 | 2.9 | 4.9 | 1.711 | 1.605 | 6.60 | 3.5 |
| Comparative Example 7 | 250 | 182 | 22 | 1.2 | 5.1 | 6.8 | 1.621 | 1.531 | 5.88 | 2.1 |
| Comparative Example 8 | 255 | 160 | 23 | 1.2 | 5.2 | 7.1 | 1.631 | 1.539 | 5.98 | 2.3 |
| Comparative Example 9 | 265 | 266 | 27 | 1.2 | 4.1 | 6.9 | 1.645 | 1.501 | 9.59 | 4.2 |

In Tables 1 to 4, a c/a deviation Δc/a was calculated based on c/a values measured by TEM analysis at the points ¼t and ½t by using the following inequalities.

$$|(c/a_{(1/4t)}-c/a_{(1/2t)}|\times(c/a_{(1/2t)})^{-1}\times 100\leq 5$$

$c/a_{(1/4t)}$ indicates an aspect ratio of a hexagonal close packed (HCP) lattice structure at the point ¼t in the thickness direction.

$c/a_{(1/2t)}$ indicates an aspect ratio of a hexagonal close packed (HCP) lattice structure at the point ½t in the thickness direction.

According to Examples 1 to 7, the magnesium alloy plate is manufactured by applying the constraint member and the plate-like magnesium casting material selected in consideration of Relational Expression 1 for the difference in strain resistance proposed by the present invention while satisfying Relational Expressions 2 and 3 related to a number of passes for the rolling with a reduction ratio of $\varepsilon_{eff}$ or more and a cumulative reduction ratio.

Referring to Table 4, it can be seen that a non-basal texture formation behavior proposed by the present invention is satisfied, and thus an average value of a texture intensity within a misorientation level of 30° or less is 3 or less based on an [0001] orientation of a (0002) plane. In addition, it can be seen that a deviation of c/a values of a hexagonal closed packed (HCP) crystal structure in the plate may be 5 or less. As a result, a magnesium alloy rolled plate capable of securing a limited dome height of about 10 to 14 mm at room temperature could be finally manufactured.

According to Comparative Examples 1 to 3 which shows a result of an alloy rolled plate manufactured by an ordinary rolling method using only the magnesium casting material, instead of the manufacturing method based on application of the constraint member proposed by the present invention, it can be confirmed that the non-basal texture is not developed as can be seen from the average value of the bonding strength of the texture within the misorientation level of 30° or less based on the [0001] orientation of the (0002) plane of Table 4 even after the final heat treatment, and the uniformity of the non-basal texture may be deteriorated to not secure the excellent cold formability as can be seen from the c/a deviation.

Comparative Examples 4 and 5 show a case where an effective range of Relational Expression 1 is different from the strain resistance difference between the applied magnesium alloy and the constraint member. Specifically, according to Comparative Example 4 which shows a case where the pure aluminum plate is used as a constraint member, it is seen that the MFS is about 15 MPa, which is very low compared to the magnesium casting material (120 MPa) in a temperature region of 400° C. in which the rolling is performed, and it is seen that a result of substitution in Rotational Expression 1 is about 0.8 or less, which is less than the effective range as confirmed in Table 2. In this case, strain resistance of the constraint member is very small, and thus the forming of the constraint member proceeds excessively in spite of a small reduction amount so that a sufficient constraint rolling effect cannot be imparted from the interface with the magnesium material to the center portion of the magnesium material. Accordingly, sufficient non-basal texture cannot be obtained at the points ½t and ¼t in the thickness direction, and formation behavior of the texture is different even in the thickness direction. According to Comparative Example 5 which shows a case where the MART steel with MFS of about 3250 MPa is applied as the constraint member in the temperature region of 400° C. in which the rolling is performed, it is seen that the strain resistance value is much higher than that of the magnesium material (120 MPa). In this case, strain resistance of the constraint member was very large compared to the magnesium material, and thus a constraint strain behavior of multi-axes from an interface of the magnesium material was not sufficiently formed/transferred, so that a constraint rolling effect could not be effectively imparted to the point of ½t in the thickness direction.

According to Comparative Example 6, since the cumulative reduction during constraint rolling was less than 30%, sufficient shear strain was not applied to the magnesium alloy rolled plate during rolling, so that the constraint rolling was effective at ½t of the magnesium alloy rolled plate, and as a result, the non-basal texture in the thickness direction becomes nonuniform, which makes it difficult to secure excellent cold formability. As shown in Table 4, when texture characteristics after rolling are examined, it is seen that the misorientation level based on the [0001] orientation of the (0002) plane is 30° or less, i.e., $I_{ave\ (1/4t)}$ (~30°) is 3 or less at the point ¼t in the thickness direction, but it exceeds 3 at the point ½t, and as a result, the uniformity of the non-basal texture may be deteriorated to not secure the excellent cold formability as can be seen from the c/a deviation.

Comparative Example 7 shows a case where the thickness ratio of the constraint member to the plate-like magnesium casting material does not exceed 5%. In this case, it is seen that since the constraint rolling effect due to the different deformation resistance behavior is secured to some extent at the interface, $I_{ave\ (1/4t)}$ (~30°) is reduced as compared with typical rolling as shown in Table 4, but the effect is insignificant. In addition, it is confirmed that $I_{ave\ (1/2t)}$ (~30°) is similar to the typical rolling, and the rolling effect is insufficient at the surface layer, but does not work at the center in the thickness direction.

Comparative Examples 8 and 9 show that the number of passes ($N_{Reff}$) in which the rolling is performed at the reduction ratio at which a strain that is equal to or greater than the effective strain ($\varepsilon_{eff}$) is applied thereto is out of the range proposed by the present invention, and in Comparative Example 8, the rolling is performed at the effective reduction ratio or more in only one of 12 passes. In other words, as shown in Table 4, in the case where the reduction amount is applied in a specific pass so that the value of the Relational Expression 3 exceeds 40 to perform the rolling to a final thickness of 1.2 mm, a peeling phenomenon occurs at the interface between the magnesium material and the constraint member due to deterioration of mass flow, thereby reducing the constraint rolling effect. Comparative Example 9 shows a case where the rolling is performed at the effective reduction ratio or more in only one of 36 passes and the reduction ratio per pass is less than a value 3 given in Relational Expression 3, and it is seen that formation of the non-basal texture in the magnesium alloy rolled plate is not effective and the texture is not uniform even in thickness direction.

More detailed textures and physical property evaluation results according to the examples and the comparative examples will be described with reference to the drawings.

FIG. 1 illustrates an observation result of crystal texture of a magnesium alloy rolled plate, which is generally subjected to steps (a) to (d), followed by being rolled in a typical rolling process and being subjected to a step (g), using electron backscatter diffraction (EBSD) according to Comparative Example 1. An observation area is a point ¼t in a thickness direction.

Figure 2:
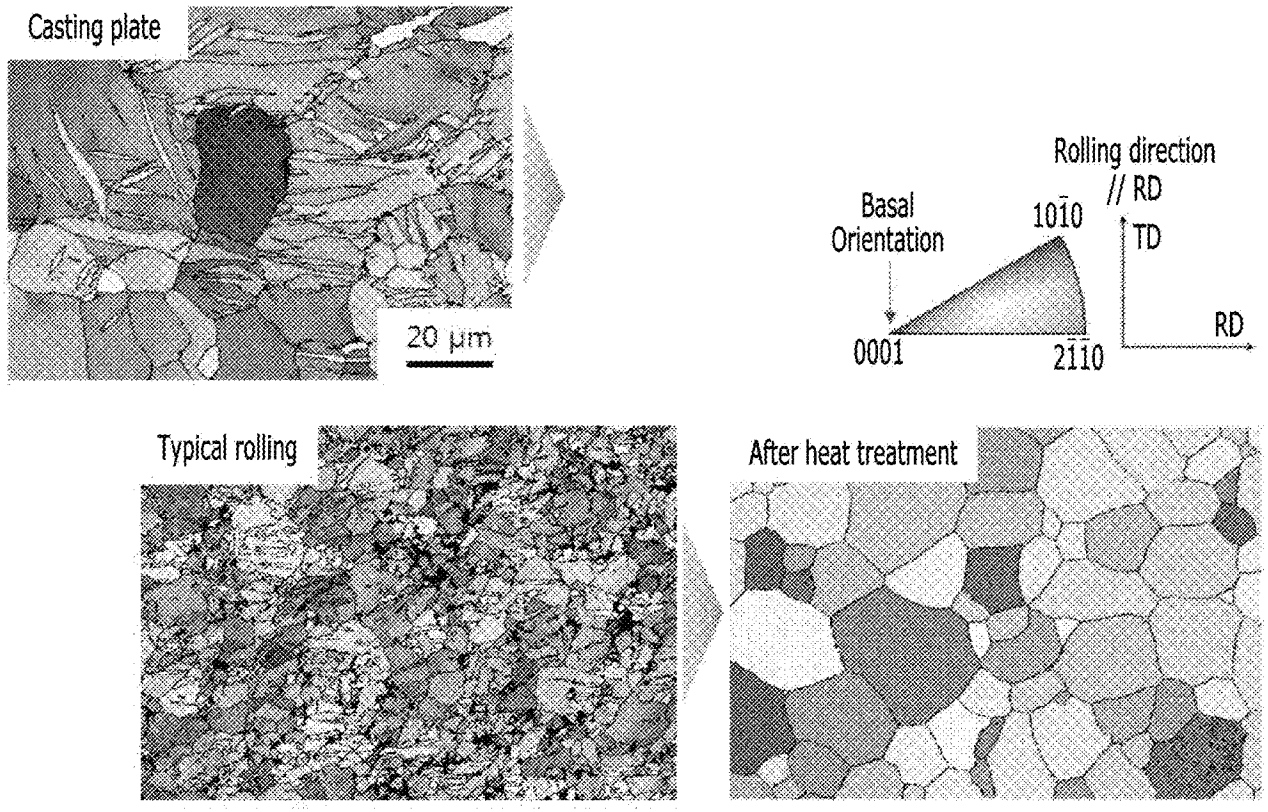
FIG. 2 illustrates a crystalline structure of a magnesium alloy rolled plate using EBSD according to Example 1.

FIG. 2 illustrates crystal texture of a magnesium alloy rolled plate at a point ¼t in a thickness direction, which is subjected to constraint-rolling at a cumulative reduction ratio of 70% using a constraint member STS304 without adding a special element such as yttrium or calcium, and then is subjected to heat treatment at 400° C. for 1 hour and furnace-cooling according to Example 1.

Figure 3:
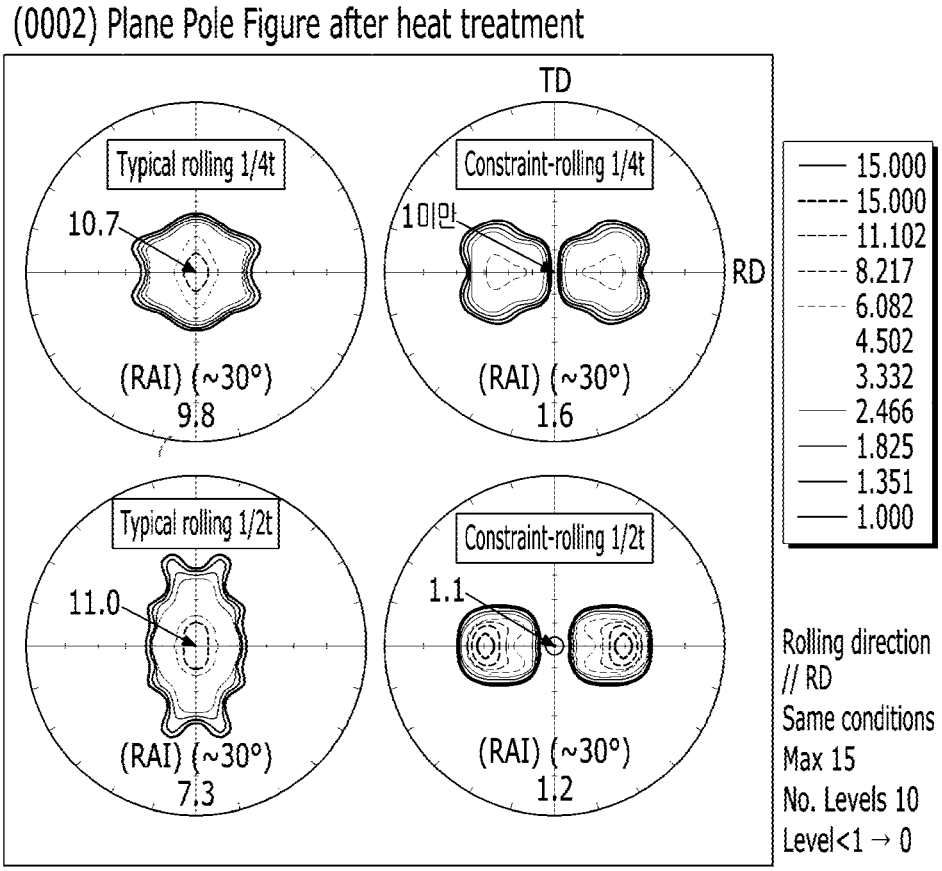
FIG. 3 illustrates a distribution of crystal orientations based on a (0002) plane at points ¼t and ½t in Example 1 and Comparative Example 1.

FIG. 3 illustrates a distribution of crystal orientations based on a (0002) plane at points ¼t and ½t in a thickness direction after heat treatment depending on whether constraint-rolling is applied or not.

As can be seen from FIG. 1, a crystal orientation of the magnesium alloy plate rolled without application of constraint-rolling clearly shows a basal texture in which the crystal orientation is concentrated in the [0001] orientation of the (0002) plane, and a fraction of double twin is very low. However, when the constraint-rolling is performed as in FIG. 2, a considerably high fraction of double twin is confirmed, and a degree of concentration of the crystal orientation is also alleviated in the [0001] orientation based on the (0002) plane.

In addition, when compared with textures after heat treatment, a size of crystal grains of the texture by typical rolling is comparatively large (average diameter of 30 μm), which is considered to be a result of heat treatment above a recrystallization temperature. However, it can be seen that in the case of the constraint-rolling material, a very fine texture is formed considering that an average diameter is 12 μm and a thickness of the magnesium alloy rolled plate is about 1.2 mm. This is considered to be the result of allowing the double twin generated during constraint-rolling to serve as a site of recrystallization during heat treatment even without yttrium or calcium.

As can be seen from FIG. 3, in the case of a typical rolled material, the crystal orientation distribution based on the (0002) plane differs in the thickness direction, but in the case of the constraint-rolling material, it is seen that the basal texture is sufficiently alleviated at both of the points ¼t and ½t, and the azimuthal distribution behavior is also similar.

The present invention may be embodied in many different forms, and should not be construed as being limited to the disclosed embodiments. In addition, it will be understood by those skilled in the art that various changes in form and details may be made thereto without departing from the technical spirit and essential features of the present invention. Therefore, it is to be understood that the above-described exemplary embodiments are for illustrative purposes only and the scope of the present invention is not limited thereto.

The invention claimed is:

1. A magnesium alloy plate comprising:

0.5 to 10 wt % of zinc (Zn), 1 to 15 wt % of aluminum (Al), and a balance of magnesium (Mg) and inevitable impurities, wherein an average value of a texture intensity within a misorientation level of 30° or less is 3 or less based on an [0001] orientation of a (0002) plane, wherein a deviation of c/a values of a hexagonal closed packed (HCP) crystal structure in the plate is 5% or less, and wherein a limited dome height (LDH) at room temperature is 10 mm or more.

2. The magnesium alloy plate of claim 1, wherein a thickness is in a range of 0.4 to 2 mm.

3. The magnesium alloy plate of claim 2, wherein the magnesium alloy plate has a non-basal texture that is uniform in a thickness direction.

4. A manufacturing method of a magnesium alloy plate, the method comprising:

(a) solution-treating a magnesium casting material containing 0.5 to 10 wt % of zinc (Zn), 1 to 15 wt % of aluminum (Al), and a balance of magnesium (Mg) and inevitable impurities at 300 to 500° C. for 1 to 48 hours;

(b) pre-heating the solution-treated magnesium casting material at 300 to 500° C.; and (c) rolling the pre-heated magnesium casting material together with a constraint member selected by following Relational Expression 1 to satisfy Relational Expressions 2 and 3; and (d) solution-treating a thus-rolled magnesium alloy plate at 300 to 500° C. for 0.5 to 5 hours, wherein the rolling is constrained rolling that is performed at a cumulative reduction ratio of 70% or more:

$$1<|(\sigma_{mat}-\sigma_{mg})|\square\sigma_{mg}^{-1}<20 \qquad \text{Relational Expression 1}$$

wherein $\sigma_{mat}$ and $\sigma_{mg}$ are the constraint member and a mean flow stress (MFS)(MPa) of the magnesium material, respectively, $$0.4<N_{Reff}\times(N_{Rtotal}-1)^{-1} \qquad \text{Relational Expression 2}$$

wherein $N_{Reff}$ is a number of rolling passes to which a strain that is equal to or greater than an effective strain ($\varepsilon_{eff}$) is applied, and $N_{Rtotal}$ is a total number of rolling passes, and $$3<\varepsilon_{eff}\times 100<40 \quad \text{Relational Expression 3}$$

wherein $\varepsilon_{eff}=|(T-T_0)|\times L_{ini}^{-1}$, and $T_0$ (mm) and T (mm) are pre-deformation and post-deformation thicknesses of the magnesium plate, respectively, and $L_{ini}$ has the same meaning as $T_0$.

5. The manufacturing method of claim 4, wherein the constraint member is designed to have a thickness exceeding 5% of the magnesium casting material.

6. The manufacturing method of claim 4, wherein an oil-coating treatment or a plating treatment is further performed after the rolling.

* * * * *